United States Patent [19]

Rudd

[11] Patent Number: 4,462,119

[45] Date of Patent: Jul. 31, 1984

[54] FACE SHIELD AND HELMET

[75] Inventor: Thomas H. Rudd, Minneapolis, Minn.

[73] Assignee: Drag Specialties, Inc., Minnetonka, Minn.

[21] Appl. No.: 303,406

[22] Filed: Sep. 18, 1981

[51] Int. Cl.[3] ..... A61F 9/04; A42B 3/00

[52] U.S. Cl. ..... 2/424; 2/429

[58] Field of Search ..... 2/424, 10, 9, 6, 8, 2/441, 427, 429

[56] References Cited

U.S. PATENT DOCUMENTS

| | | | |
|---|---|---|---|
| 2,864,088 | 12/1958 | Gongoll | 2/441 |
| 3,594,816 | 7/1971 | Webb | 2/10 |
| 3,774,239 | 11/1973 | Kotzar | 2/10 |
| 4,023,210 | 5/1977 | Hanson | 2/10 |
| 4,070,712 | 1/1978 | Marwitz | 2/424 |
| 4,097,929 | 7/1978 | Lowe et al. | 2/424 X |
| 4,117,553 | 10/1978 | Bay | 2/10 |

FOREIGN PATENT DOCUMENTS

| | | | |
|---|---|---|---|
| 2024000 | 1/1980 | United Kingdom | 2/424 |

*Primary Examiner*—Peter P. Nerbun

*Attorney, Agent, or Firm*—Kinney & Lange

[57] ABSTRACT

A face shield for a helmet comprising a shield body member for removable attachment to the helmet and having an aperture for free vision of the wearer, a replaceable transparent face shield having a shape substantially similar to the aperture and means for removably attaching the transparent panel to the body member in juxtaposition to the aperture. Also included is a means for automatically restraining the shield body member in at least one predetermined position.

7 Claims, 6 Drawing Figures

FACE SHIELD AND HELMET

BACKGROUND OF THE INVENTION

This invention relates generally to a face shield structure for use in conjunction with an open face helmet.

A great many operators of open cockpit vehicles, in particular operators of motorcycles, wear helmets for their protection and because of laws passed by the various governmental levels. In order to protect riders from dangers encountered by and the possibility of trash, debris, or the like striking the face, many different types of face shields have been designed and manufactured. Such face shields generally include a curved, transparent member which is rigidly affixed to a helmet with the bottom edge open so that the helmet and attached face shield can be placed over the head of the wearer.

It is well known that the transparent member of the face shield becomes scratched or soiled so as to prevent clear vision. Attempts to clean the transparent member usually result in further scratching of the durable plastic or similar material of which the shields are typically composed. Restricted vision poses obvious hazards to operators of high speed vehicles or other powerful machinery. Further interference with the wearer's vision is caused by changes in the lighting conditions of the surrounding environment. In dim lighting a clear transparent panel should be used to allow all possible light to reach the wearer's eyes. In bright sunlight a tinted panel would be advantageous to filter out excessive glare. Also the face shield often becomes fogged by condensation of the wearer's breath on the inside of the transparent portion of the shield. Further, face shields which generally overlay the wearer's face can cause discomfort by unduly restricting the air circulation when the wearer is moving at a slow speed or air velocity relative to the helmet is slowed or stopped. Many attempts have been made to solve each of these problems separately; but, none of the previous attempts have been totally successful in solving all of these problems at the same time.

Detachable shields have been used so that they may be replaced when they become scratched or changed when the light conditions dictate. However, replacement of the entire shield is expensive and wasteful when the shield is composed of material of sufficient thickness to provide durable shielding from high velocity air, debris or similar matter or protection in the event of an accident. Further the prior art detachable shields lock into position so as to do nothing to overcome the problems of fogging and restricted air circulation. Inexpensive thin plastic removable coverings, which could be stretched or attached over the surface of thicker expensive permanent shield have been devised and used with only limited success. Moisture, oil, dirt, sand, and grit becomes trapped between the thin covering and the permanent shield. Entrapped grit causes scratching of the permanent shield when the two shields are vibrated relative to each other by buffeting winds. This mandates frequent and expensive permanent shield replacement.

Face shields designed to be attached to helmets so that they may be pivoted into and out of a shielding position have been used to alleviate some of the air circulation problems associated with low speed use. However, freely pivoting face shields, which allow uncovering of the wearer's face, are often unpredictably and violently pivoted upwardly by high velocity air currents. This exposes the wearer's face to flying debris and also dangerously jerks back the wearer's head and neck, possibly causing severe injury. Up to the present time such violent pivoting was prevented by the application of devices for rigidly locking the face shield in a downward, shielding position. Those prior art locking devices which could be engaged or disengaged while the helmet was being worn, required the wearer to disengage the devices with one hand while pivoting the shield upwardly with the other. Alternatively, using a single hand, the wearer could both dissengage and pivot the shield, only with much physical effort and by positioning that one hand in awkward and possibly dangerous locations behind the head or in the path of view. Such devices are of limited use to operators of high speed or unstable vehicles, such as motorcycles, which require at a minimum one hand on the controls and clear unobstructed vision at all times. It is with these problems in mind that the replaceable transparent panel and the automatic restraining and releasing detent mechanism in this invention has been developed.

BRIEF SUMMARY OF THE INVENTION

The present invention overcomes the problems in the prior art associated with expensive shield replacement, internal fogging, poor air circulation and dangerous inadvertent upward pivoting of the shield.

Briefly, the present invention relates to a face shield for a helmet comprising a shield body member for removable attachment to the helmet and having an aperture for free vision of the wearer, a replaceable transparent face panel having a shape substantially similar to the aperture and means for removably attaching the transparent panel to the body member in juxtaposition to the aperture.

Further the present invention comprises means for automatically restraining the shield body member in at least one predetermined position.

DESCRIPTION OF THE PREFERRED EMBODIMENT

Figure 1:
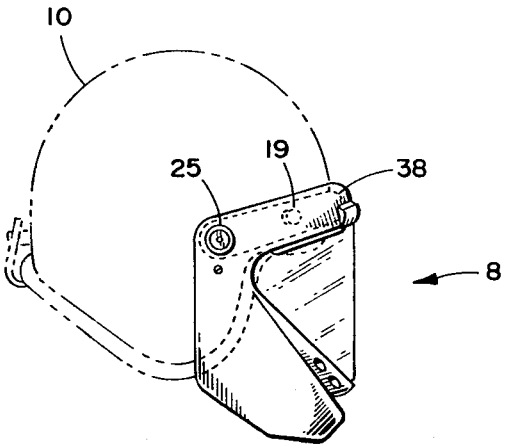
FIG. 1 is a side view of a helmet with a prior art face shield attached.

Referring now to the drawings, FIG. 1 discloses a helmet with a prior art face shield attached. The helmet is generally indicated by reference numeral 10 and has coupling band 16 attached thereto by at least one affixing snap 19. Also, shown is face shield 8 pivotally attached to coupling band 16 by pivotal attachment means 25 which may be any well known connector coupling pivot points on the shield with pivot points on the coupling band.

Figure 2:
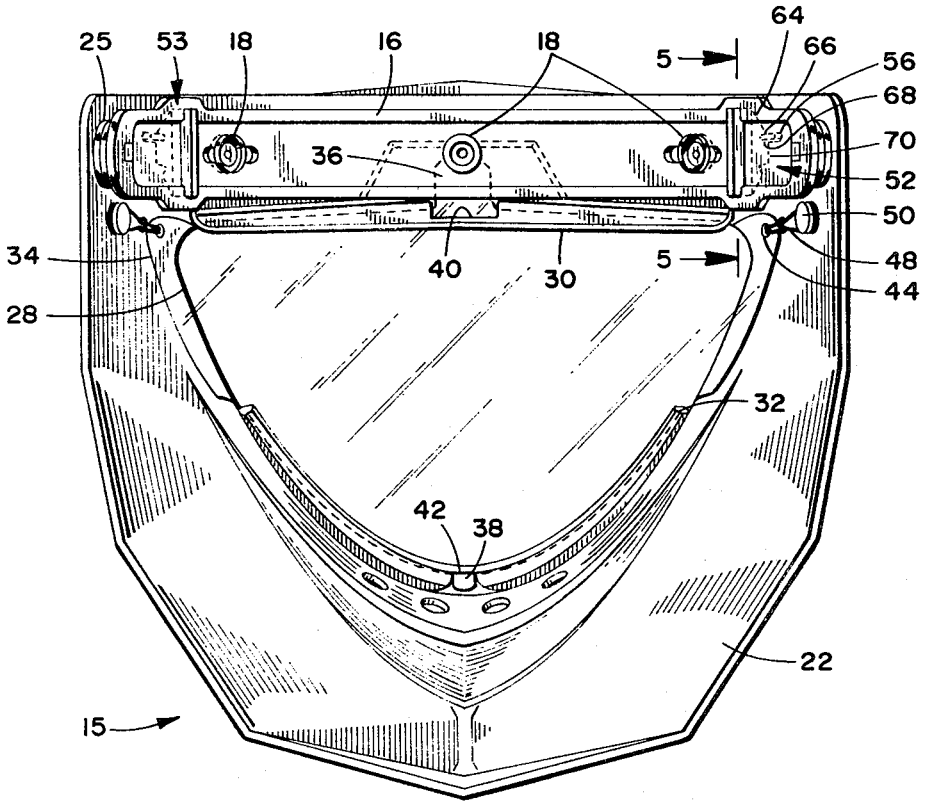
FIG. 2 is a back view of the face shield body member showing the coupling bands and replaceable transparent panel attached thereto.
Figure 3:
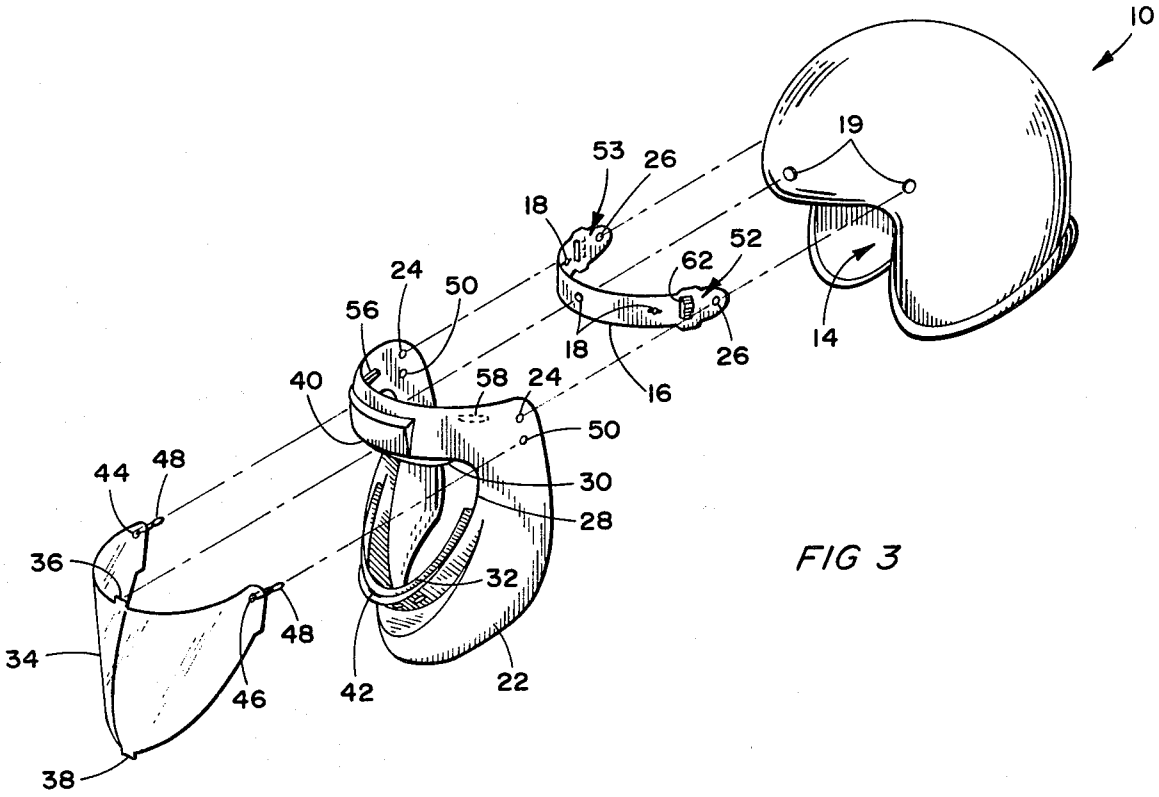
FIG. 3 is an exploded perspective view showing the connective relationships between the helmet and the coupling band, the coupling band and the shield body member, and the shield body member and the transparent panel.

The working parts of the inventive face shield, generally indicated by numeral 15, are shown fully constructed in the back view in FIG. 2 which, in conjunction with FIG. 3, best illustrates the construction of the present invention. Pivotal coupling band 16 is generally attached to helmet 10 preferably by engaging the female affixing snaps 18, which are fastened to coupling band 16, with the male affixing snaps 19 (of FIG. 1) which are fastened to the helmet 10 in predetermined locations corresponding to the location of female affixing snaps and generally above the open face portion 14 of the helmet 10.

The shield body member 22, depicted in FIGS. 2 and 3, is pivotally attached to pivotal coupling band 16, as can be understood by references to FIG. 3, using pivotal attachment means 25, thereby pivotally interconnecting body pivot points 24 with band points 26. The body member 22 is thus located adjacent the coupling band 16 with a predetermined clearance at each point around the arc of the coupling band 16 when the body member 22 is in a position overlaying the wearer's face. The predetermined clearance permits the shield 22 to pivot without frictional contact with the coupling band.

Figure 4:
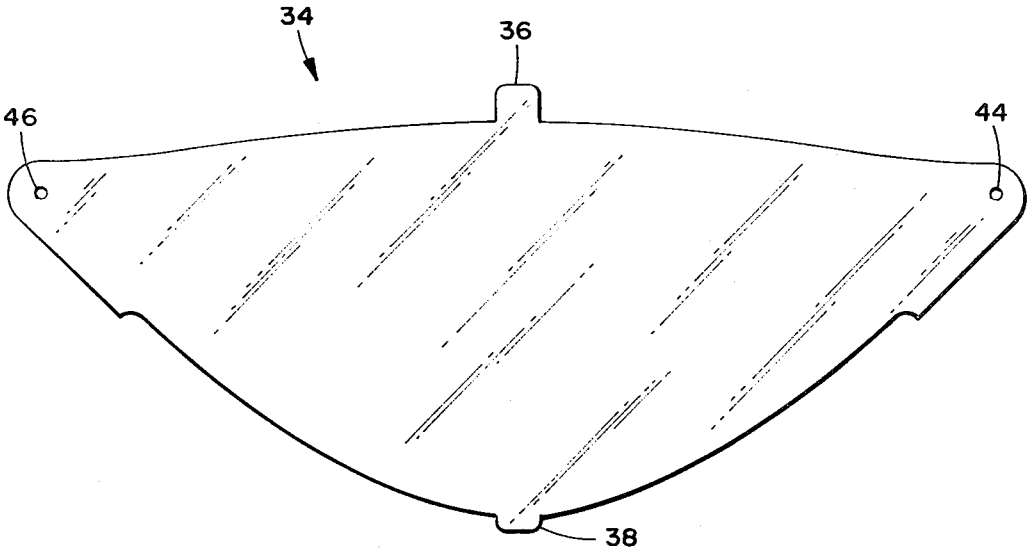
FIG. 4 is a front view of a flattened replaceable transparent panel.
Figure 6:
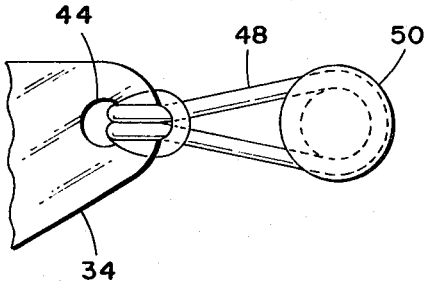
FIG. 6 is a fragmentary side view of the transparent panel stabilizing means comprising the attachment orifice, flexible connector, and attachment projection.

Aperture 28 is shown formed in shield body member 22 as can be seen in FIG. 2 and FIG. 3. A ledge portion is attached to shield body member 22 so as to project into aperture 28. Preferably the ledge portion consists of a sturdy upper ledge portion 30 and a sturdy lower ledge portion 32. The replaceable transparent panel generally indicated by numeral 34 as shown in FIG. 3 and FIG. 4 is formed in a shape substantially conforming to the shape of aperture 28 and preferable formed of flexible transparent material which may be clear plastic with a bias to remain in a flattened configuration as shown in FIG. 4. Panel 34 is manually curved as shown in FIG. 3 to generally conform to the shape of ledges 30 and 32, and is replaceably attached to shield body member 22 in juxtaposition to aperture 28. Preferably, attachment of panel 34 to body member 22 is achieved by insertion of lower tab 38 formed on the transparent panel 34 into lower slot 42 formed in shield body member 22 and by insertion of upper tab 36, formed on the transparent panel 34, into upper slot 40 which is formed in the shield body member 22. Further stabilization of replaceable transparent panel 34 is accomplished using flexible connectors 48 shown in FIGS. 2,3, and 6 attached to transparent panel 34 through orifices 44 and 46 formed therein and removably interconnected with attachment projection 50 as shown in FIG. 2 and FIG. 6. The replaceable panel can thus be easily replaced when it becomes scratched. A thin inexpensive replaceable panel can be used because the replaceable panel derives sufficient strength from being stressed into a curved configuration, from abutting against the strudy ledges and from the stabilizing connectors.

Figure 5:
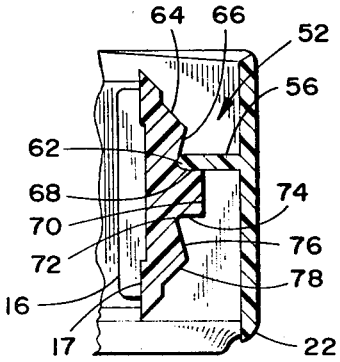
FIG. 5 is a section view of an engaged automatic detent restraining and releasing means.

A first automatic detent restraining and releasing means 52 as shown in FIG. 2 and FIG. 5, is used, to restrain the face shield body member 22 in a downward position over the wearer's face as shown in FIG. 1. The preferable embodiment of the automatic restraining and releasing means 52 shown in FIGS. 2,3, and 5 is comprised of detent protrusion 56, attached to, or preferably integrally formed on, shield body member 22 in a predetermined location for engagement with detent groove 60 which is attached to, or preferably integrally formed on, pivotal coupling band 16 in a corresponding location for engagement as shown in FIGS. 2 and 5. To insure secure holding of said shield body member in a downward position generally overlaying the wearer's face, a second detent restraining and releasing means 53 is preferably used similarly comprised of detent protrusion 58 integrally formed on shield body member 22 in a predetermined location for engagement with detent groove 62 integrally formed on pivotal coupling band 16 as shown in FIG. 2 and FIG. 3.

In the preferred embodiment detent groove 60 is formed as a series of surfaces as can be best understood with reference to FIG. 5. Ramp surface 64 is formed outwardly inclined from the surface 17 of coupling band 16. Slide surface 66 is formed adjacent to ramp surface 64 in communication with the crest of ramp surface 64, thereby forming a projection with a triangular cross section. Rectangular block 70 is formed adjacent to slide surface 66 thereby forming groove 60 at the intersection of block surface 68 and slide surface 66. This configuration allows protrusion 56 to be guided outwardly along ramp surface 64, against the bias created by holding body member 22 at a predetermined clearance distance from the coupling band 16, when body member 22 is pivoted toward a position overlaying the wearer's face. With further pivoting of body member 22, protrusion 56 comes into contact with slide surface 66 and is guided into engagement with detent groove 60 and abuts against horizontal surface 69 on rectangular block 70. Protrusion 56 can be disengaged from detent groove 60 by application, in the opposite direction, of enough pivotal force to slide protrusion 56 slide surface 66 against the bias created by holding a predetermined clearance between body member 22 and coupling band 16. The slope and the rise of ramp surface 64 and slide surface 66 determine the force required to engaged and disengage protrusion 56 and detent groove 60. Preferably this force is established to be greater than the maximum force created by buffeting air currents yet less than that force which can be physically applied by the wearer using one hand.

To prevent upside down attachment of the coupling band 16 onto helmet 10, duplicate detent groove 72 is preferably formed as the mirror image of the detent groove 60 about rectangular block 70 by duplicate horizontal surface 74, slide surface 76 and ramp surface 78 adjacent as shown in FIG. 5, each of which would perform the functions of slide surface 64, ramp surface 66 and horizontal surface 68 respectively, if band 16 were attached to helmet 10 upside down. This would facilitate the assembly procedure and prevent malfunctions caused by upside down attachment of coupling band 16 to helmet 10. In the preferred embodiment detent groove 62 is similarly constructed at a separate location on coupling band 16.

Thus, there has been disclosed a novel and unique face shield for a helmet which not only has a replaceable transparent panel but also has a face shield and which is pivotable upwardly away from the face but yet which has a locking mechanism which holds the face shield body in the downward position in superimposed relationship with the face of the wearer.

While the invention has been described in connection with a preferred embodiment, it is not intended to limit the scope of the invention to the particular form set forth, but, on the contrary, it is intended to cover such alternatives, modifications and equivalents as maybe included within the spirit and scope of the invention as defined in the appended claims.

What is claimed is:

1. A face shield for a helmet comprising:

a. a body member for attachment to a helmet, at least a portion of said body member being transparent to allow vision when interposed in the path of view of the wearer;

b. at least one coupling band for pivotally attaching said body member to said helmet;

c. at least one detent groove attached to said coupling band wherein said detent groove is comprised of at least one ramp surface upwardly inclined from the surface of said coupling band, at least one slide surface located adjacent to said ramp surface and extending downwardly from said ramp surface, and at least one rectangular projection on said coupling band having one vertical side adjacent to said slide surface thereby forming said detent groove between said slide surface and said vertical side of said rectangular projection; and d. at least one protrusion attached to said body member at a location adjacent to and engaging said detent groove for automatically restraining said pivotally attached body member when in the path of view of said wearer and for automatically releasing said body member from said restrained position when a predetermined pressure is applied thereto, thereby enabling said body member to be pivotally moved away from the path of view of said wearer.

2. A face shield as in claim 1 wherein said flexible connector is a rubber band.

3. A face shield as in claim 2 wherein:

a. said ledge is integrally formed in said body member;

b. said slot is integrally formed in said body member adjacent said ledge; and c. said tab is integrally formed on said replaceable panel.

4. A face shield as in claim 3 further comprising:

a. at least one coupling band for pivotally attaching said body member to said helmet; and b. means associated with said coupling band and said body member for automatically restraining said pivotally attached body member in at least one predetermined pivotal position.

5. A face shield as in claim 1 wherein said automatic restraining and releasing means further comprises at least two of said detent grooves wherein one of said detent grooves is formed as the mirror image of the other detent groove symmetrically about said rectangular projection for engagement in the event said coupling band is inverted when attached to said helmet.

6. A face shield as in claim 5 wherein said detent groove in integrally formed on said coupling band and said protrusion is integrally formed on said body member.

7. A face shield for a helmet comprising:

a. a shield body member for attachment to a helmet and having an aperture therein for free vision of the wearer, a ledge attached to said body member, said ledge projecting inwardly into at least a portion of said aperture, at least one slot formed in said body member adjacent said aperture;

b. at least one replaceable transparent face panel having a shape substantially similar to said aperture, at least one orifice formed in said replaceable panel, at least one tab on said replaceable panel for removable insertion into said slot for locking said replaceable panel in place; and c. means for removably attaching said replaceable panel to said body member in juxtaposition to said aperture, at least one flexible connector attached to said replaceable panel through said at least one orifice, at least one projection attached to said body member for removably receiving said flexible connector to further stabilize said replaceable panel.

* * * * *